US006244905B1

(12) United States Patent
Wang

(10) Patent No.: US 6,244,905 B1
(45) Date of Patent: Jun. 12, 2001

(54) JACK CONNECTOR WITH RELIABLY RETAINED CONTACTS

(75) Inventor: Zhiqiang Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/639,519

(22) Filed: Aug. 15, 2000

(30) Foreign Application Priority Data

May 25, 2000 (TW) ..... 089208924

(51) Int. Cl.[7] ..... H01R 24/04
(52) U.S. Cl. ..... 439/668; 439/669
(58) Field of Search ..... 439/668, 669

(56) References Cited

U.S. PATENT DOCUMENTS 4,165,147 * 8/1979 Buck ..... 439/188
6,056,602 * 5/2000 Wu ..... 439/668
6,116,959 * 9/2000 Taylor ..... 439/668

* cited by examiner

*Primary Examiner*—Gary F. Paumen
*Assistant Examiner*—Edwin A. León
(74) *Attorney, Agent, or Firm*—Wei Te Chung

(57) ABSTRACT

An electrical jack connector includes an insulative housing (10), a metallic shell (90), and a first, second, third and fourth electrical contacts (30), (50), (70), (80) mounted in the insulative housing. The first and second electrical contacts are similar in shape except that the first contact comprises a contact portion (36) for engaging with an engaging portion (73) of the third contact (70) when a complementary plug connector (95) is not mated with the jack connector. The first and second contacts are securely retained in a pair of recesses (120), (160) defined in a side wall of the housing. The third contact is securely retained by a cutout (21) in a top wall (17) of the housing and a pair of grooves (22) in a bottom wall (18) of the housing. The first, second and third contacts have relatively simple shapes and are thus easy to manufacture.

1 Claim, 5 Drawing Sheets

JACK CONNECTOR WITH RELIABLY RETAINED CONTACTS

BACKGROUND OF THE INVENTION

1. Field of the Invention

The present invention relates to an electrical connector, and particularly to an electrical jack connector which receives a plug connector therein.

2. Description of the Prior Art

Referring to FIG. 5, a conventional jack connector comprises an insulative housing 100 and a first, second and third electrical contacts 101, 102, 103 mounted in the insulative housing 100. The insulative housing 100 defines a pair of recesses 109 and a cavity 109' therein. The first and second electrical contacts 101, 102 are substantially identical in shape and each comprises a hollow frame portion 104, a tongue 105 upwardly and outwardly extending from a lower side of the frame portion 104, and a tail 106 extending downwardly and opposite to the tongue 105 from the frame portion 104. The third electrical contact 103 comprises a pair of retention plates 107 and an intermediate portion 108 therebetween. The retention plates 107 are parallel to each other. The frame portions 104 of the first and second electrical contacts 101, 102 and the retention plates 107 of the third electrical contact 103 are retained in the grooves 109 and the cavity 109', respectively.

Manufacturing the above electrical contacts 101–103 is complicated because of difficulties in forming the frame portions 104 and bending the tongues 105 thereof. In addition, the retentions between the frame portions 104 and the housing 100 and between the retention plates 107 and the housing 100 are not reliable, particularly after the jack connector has undergone frequent mating/unmating cycles. Such faulty retentions adversely affect signal transmission between the jack connector and a complementary plug connector mating with the jack connector.

Therefore, an improved electrical connector is required to overcome the disadvantages of the prior art.

SUMMARY OF THE INVENTION

A major object of the present invention is to provide a jack connector which includes reliably retained electrical contacts having simplified structures.

An electrical jack connector of the present invention includes an insulative housing, a metallic shell substantially enclosing the insulative housing, and first, second, third and fourth electrical contacts mounted in the insulative housing. The first and second electrical contacts are similar in shape except that the first contact comprises a contact portion for engaging with an engaging portion of the third contact when a complementary plug connector is not mated with the jack connector. The first and second contacts are retained in a pair of recesses defined in a side wall of the housing. The third contact is retained by a cutout formed in a rear edge of a top wall of the housing and by a pair of grooves defined in a rear edge of a bottom wall of the housing.

Other objects, advantages and novel features of the invention will become more apparent from the following detailed description of the present embodiment when taken in conjunction with the accompanying drawings.

DETAILED DESCRIPTION OF THE INVENTION

Figure 1:
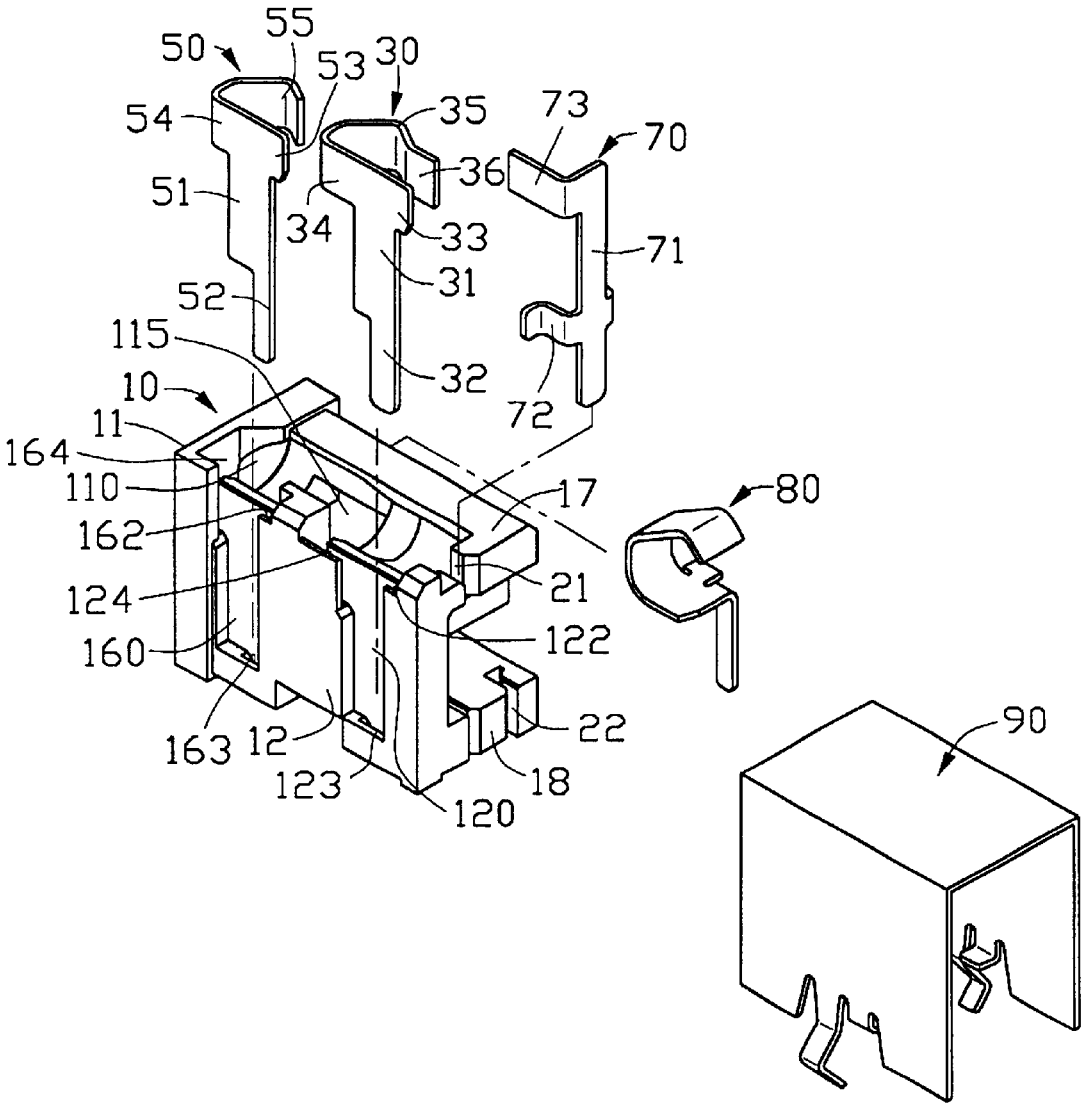
FIG. 1 is an exploded view of an electrical jack connector in accordance with the present invention.
Figure 2:
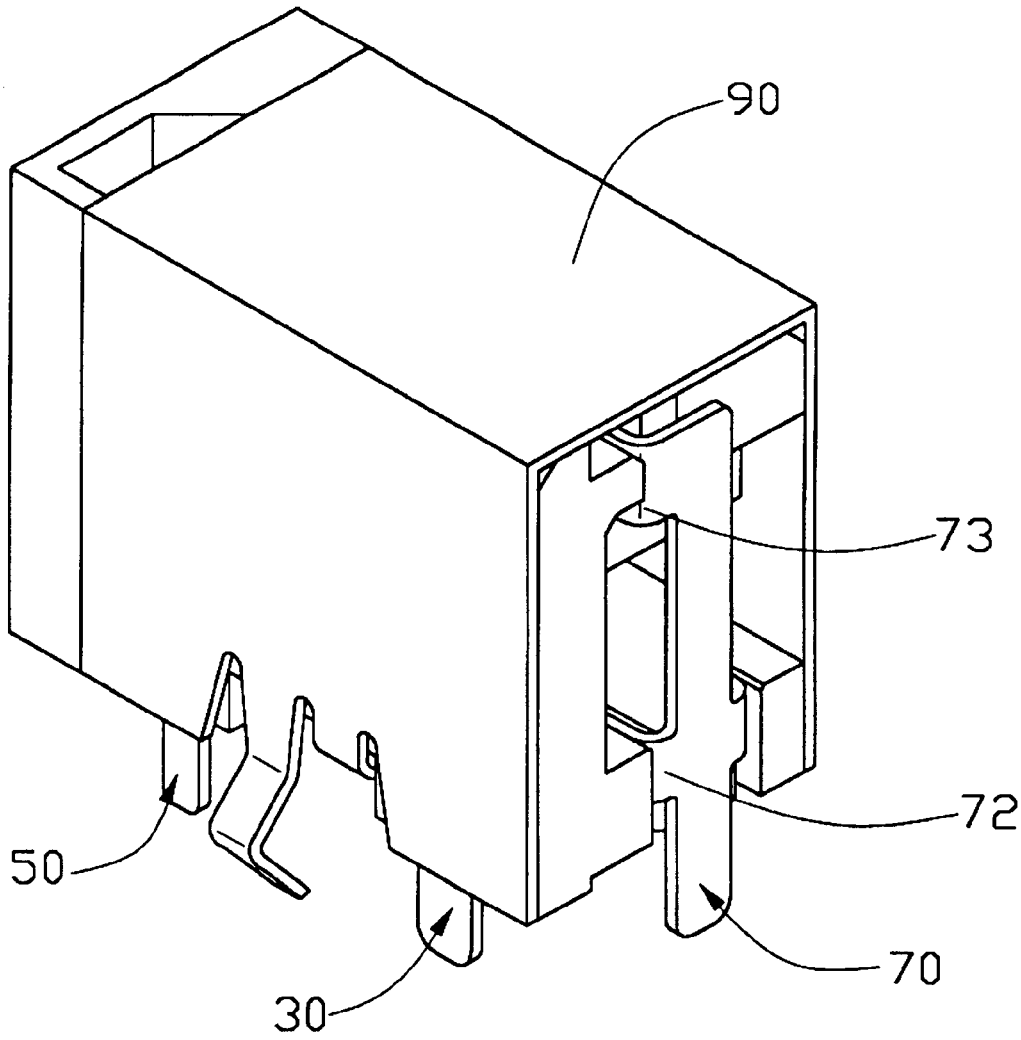
FIG. 2 is an assembled view of FIG. 1.

Referring to FIGS. 1 and 2, an electrical connector in accordance with the present invention comprises an insulative housing 10, a first electrical contact 30, a second electrical contact 50, a third electrical contact 70, a fourth electrical contact 80 and a metallic shell 90.

The insulative housing 10 comprises a front wall 11, a side wall 12, a top wall 17 and a bottom wall 18. The front wall 11 defines an opening 110 communicating with an interior space 115 of the insulative housing 10. The side wall 12 defines a pair of spaced recesses 120, 160 recessed inwardly from an outer side thereof. Each of the recesses 120, 160 is open at an upper end thereof and is bound at a lower end by the bottom wall 18. A pair of receiving slots 122, 162 is defined in an upper section of the side wall 12 in communication with the recesses 120, 160, respectively. A pair of through holes 123, 163 is defined from a lower section of the side wall 12 through the bottom wall 18. Each through hole 123, 163 communicates with a respective recess 120, 160. The recesses 120, 160 communicate with the interior space 115 via a pair of spaces 124, 164, respectively. The top wall 17 defines a cutout 21 at a rear edge thereof. The bottom wall 18 defines a pair of spaced grooves 22 at a rear edge thereof. Each groove 22 is L-shaped.

The first electrical contact 30 comprises a main body 31, a mounting tail 32 extending downward from the main body 31, a barb 33 extending from a lateral edge of a top section of the main body 31, a transition portion 34 extending opposite to the barb 33, a contact portion 36, and a curved portion 35 between the contact portion 36 and the transition portion 34. The second contact 50 is similar to the first contact 30 in shape, and comprises a main body 51, a mounting tail 52, a barb 53, a transition portion 54 and a curved portion 55. The second contact 50 does not have a contact portion.

The third contact 70 comprises an elongated major portion 71, a pair of retention portions 72 laterally and outwardly extending from opposite edges of a lower section of the major portion 71, and an engaging portion 73 extending perpendicularly from the top of the major portion 71. The retention portions 72 are mirror-imagedly configured to correspond to the grooves 22 of the insulative housing 10.

The fourth contact 80 is conventional and a detailed description of it is thus omitted herefrom.

The metallic shell 90 is also conventional and a detailed description of it is also omitted herefrom.

Figure 3:
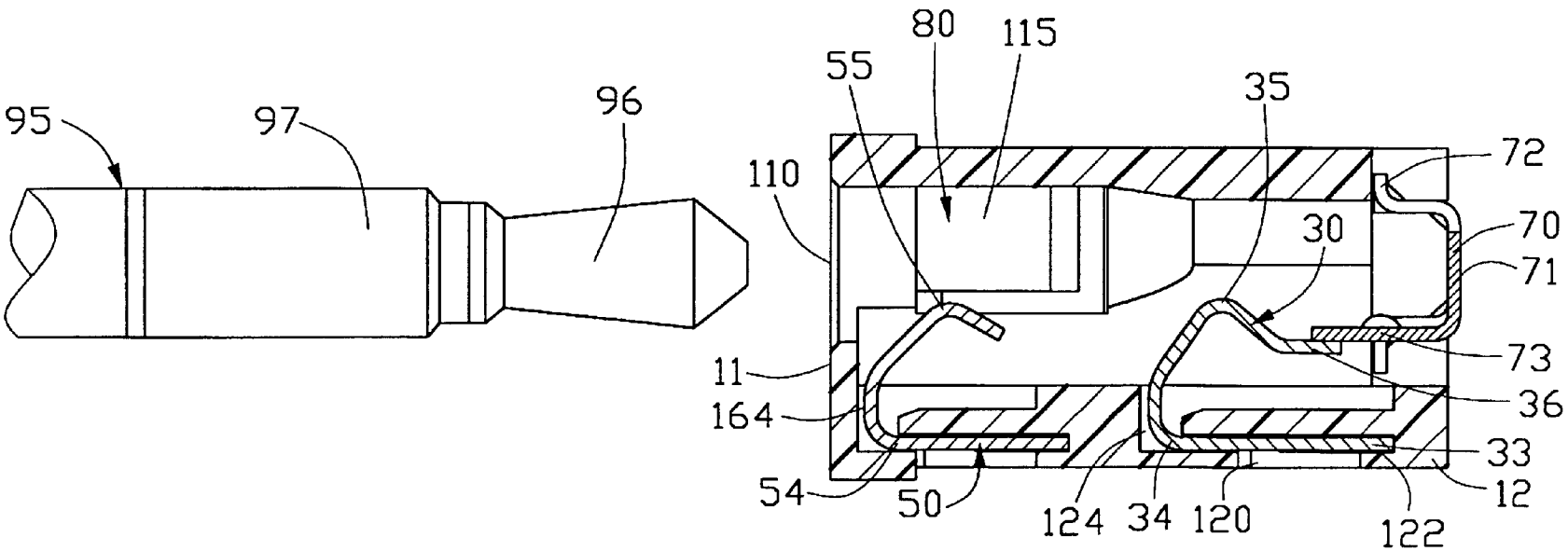
FIG. 3 is a cross sectional view of the electrical connector of FIG. 2, before a plug connector is inserted thereinto.
Figure 4:
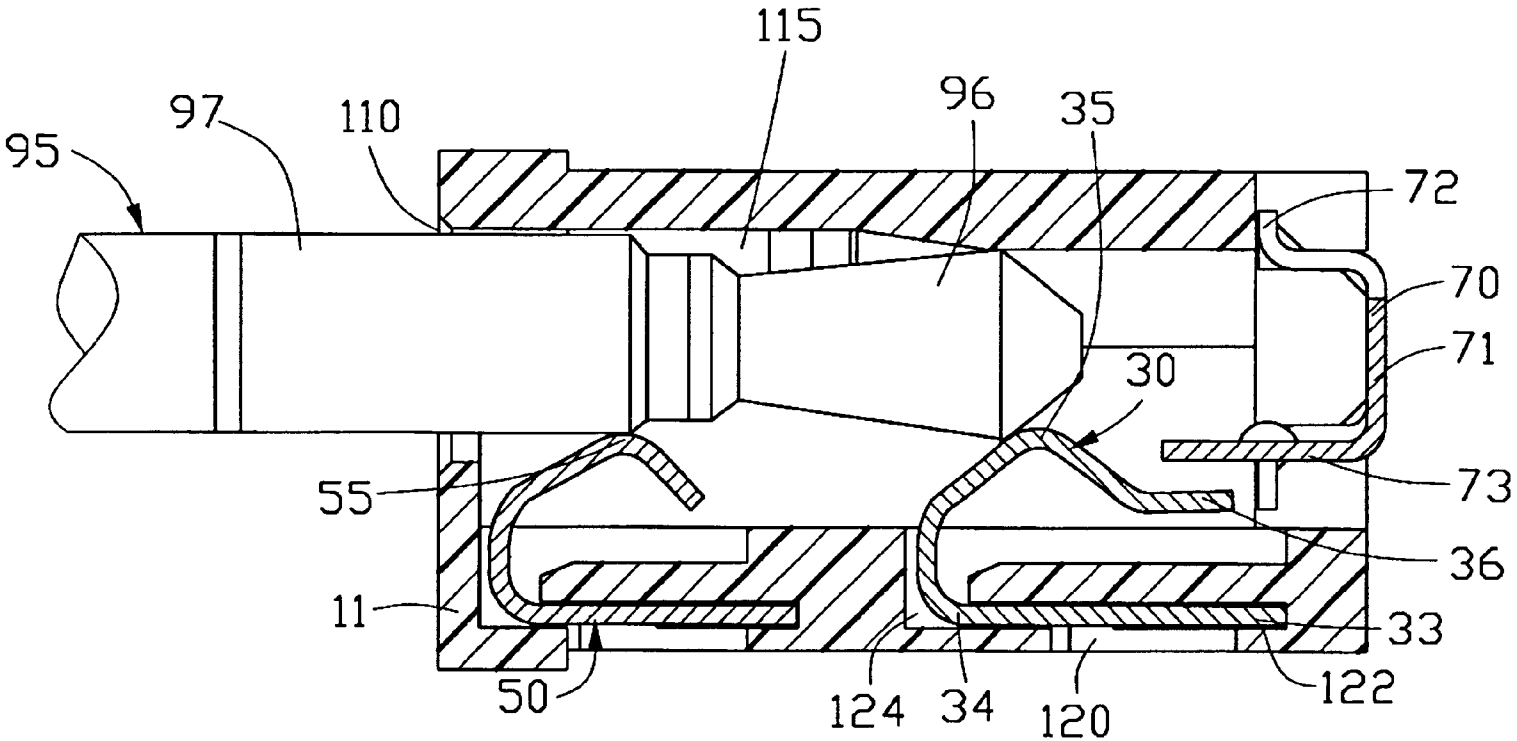
FIG. 4 is similar to FIG. 3, but with the plug connector inserted into the jack connector.
Figure 5:
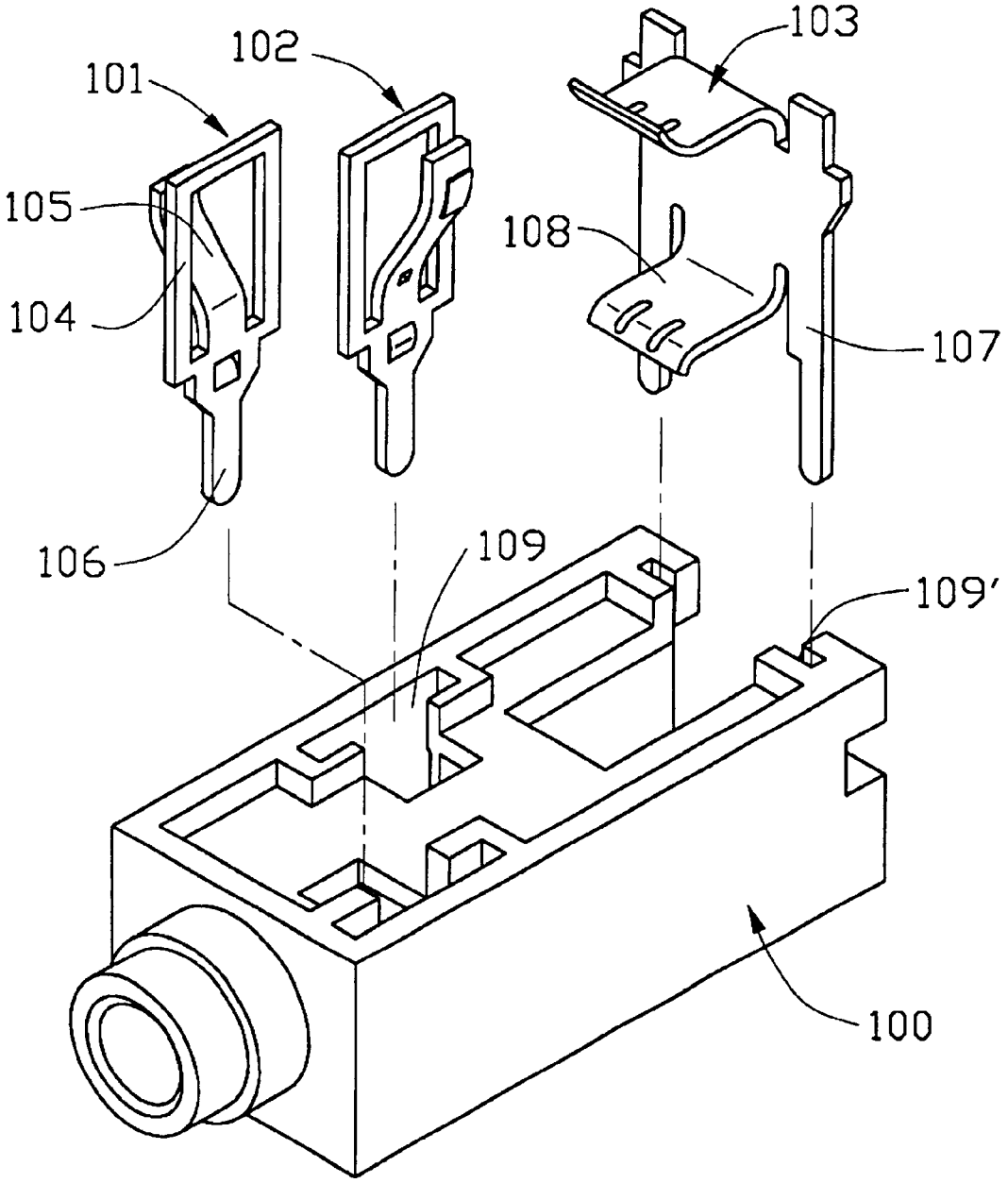
FIG. 5 (PRIOR ART)
FIG. 5 is an exploded view of a conventional electrical jack connector.

Referring to FIGS. 2–4, in assembly, the main bodies 31, 51 of the first and second contacts 30, 50 are received in the recesses 120, 160, respectively. The barbs 33, 53 are retained in the receiving slots 122, 162, respectively. The mounting tails 32, 52 of the first and second contacts 30, 50 extend through the through holes 123, 163, respectively, thereby being positioned for being mounted to a mother circuit board (not shown), on which the jack connector is mounted. The transition portions 34, 54 extend through the spaces 124, 164 whereby the curved portions 35, 55 and the contact portion 36 extend into the interior space 115 of the insulative housing 10. The major portion 71 of the third contact is positioned between the top and bottom walls 17, 18 and the retention portions 72 are retained in the L-shaped grooves 22 of the bottom wall 18. The engaging portion 73 extends through the cutout 21 into the interior space 115 of the insulative housing 10. The fourth contact 80 is inserted into the insulative housing 10 and is retained therein by conventional means. The metallic shell 90 is assembled to the housing 10 in a conventional way.

Referring now to FIGS. 3 and 4, in use, before a plug connector 95 is inserted into the opening 110 of the insulative housing 10, the contact portion 36 of the first contact 30 is engaged with the engaging portion 73 of the third contact 70. When the plug connector 95 is fully inserted into the opening 110 of the jack connector, a first contact portion 96 at a forward end of the plug connector 95 mates with the curved portion 35 of the first contact 30, and a second contact portion 97 is engaged with the second contact 50. The engagement between the first and third contacts 30, 70 is broken.

The first, second and third contacts 30, 50, 70 are retained in the insulative housing 10 via the barbs 33, 53, the transition portions 34, 54, the mounting tails 32, 52, the retention portions 72 and the engaging portion 73. All these barbs, tails and portions are reliably retained. The contacts 30, 50, 70 do not fall out of the insulative housing 10, even after repeated matings between the plug connector 95 and the jack connector. The contacts 30, 50, 70 are easy to manufacture, because there is no need to form the hollow frame portions of conventional contacts. Manufacturing costs are thus reduced.

It may be noted that the first contact 30 and the second contact 50 are vertically inserted into the through holes 123, 163 from the top, and the fourth contact 80 is laterally and horizontally inserted into the housing 10. Somewhat differently, the third contact 70 is first horizontally moved toward the housing 10 from the back until the retention portions 72 are positioned between the rear portions of the top wall 17 and the bottom wall 18, and then downwardly moved until the retention portions 72 are retained in the corresponding L-shaped grooves 22 of the bottom wall 18 and the engaging portion 73 extends through the cutout 21 of the top wall 17 into the interior space 115 of the insulative housing 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical jack connector adapted for receiving a plug connector therein, comprising:

an insulative housing including:

a front wall defining an opening for receiving the plug connector therein;

a side wall defining a first recess in an outward side thereof and a through hole therethrough, the first recess terminating at a lower section of the side wall and being in communication with the through hole, which is defined through the lower section of the side wall to a bottom face of the insulative housing; wherein the front wall and an inward side of the side wall together define an interior space of the insulative housing adjacent to both the front wall and the side wall and adapted to accommodate the plug connector therein; and an electrical first contact comprising:

a main body received in the first recess of the insulative housing;

a curved portion extending into the interior space of the insulative housing and adapted for mating with the plug connector; and a mounting tail extending through the through hole of the insulative housing to be mounted to a mother circuit board and further comprising a metallic shell generally enclosing the insulative housing thereof, the insulative housing defines a receiving slot communicating with the first recess, the electrical first contact further comprises a barb retained in the receiving slot and a transition portion between the main body and the curved portion, the insulative housing defining a space through which the transition portion extends from the first recess into the interior space of the housing, the electrical contact further comprises a contact portion extending from the curved portion opposite to the transition portion, the side wall of the insulative housing defines a second recess similar to the first recess, the second recess being spaced from the first recess, an electrical second contact similar in shape to the electrical first contact, the second contact being fixedly received in the second recess of the housing, a third electrical contact comprising at least a major portion, an engaging portion at a lateral edge of a top section of the major portion, and a pair of retention portions at opposite side edges of a lower section of the major portion, the insulative housing further comprises a top wall defining a cutout in a rear edge thereof through which the engaging portion of the third contact extends, and a bottom wall defining a pair of grooves which retain the retention portions of the third contact, the engaging portion of the third contact engages with the contact portion of the first contact when the jack connector is not mated with the plug connector, and wherein the engaging portion of the third contact disengages from the contact portion of the first contact when the jack connector mates with the plug connector and further comprising a fourth contact received in the insulative housing.

* * * * *